US007033661B2

(12) United States Patent
Whitten et al.

(10) Patent No.: US 7,033,661 B2
(45) **Date of Patent: *Apr. 25, 2006**

(54) COVERING FOR FLOORS AND/OR WALLS

(75) Inventors: Jeffrey A. Whitten, Buena Vista, VA (US); Gene C. Duff, Lexington, VA (US); Robert D. Hutchison, Daleville, VA (US)

(73) Assignee: Mohawk Brands Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/460,636

(22) Filed: Jun. 13, 2003

(65) Prior Publication Data

US 2004/0253409 A1 Dec. 16, 2004

(51) Int. Cl.
*B32B 33/00* (2006.01)
*D05C 17/02* (2006.01)

(52) U.S. Cl. ..... 428/88; 428/89; 428/92

(58) Field of Classification Search ..... 428/88, 428/89, 92

See application file for complete search history.

(56) References Cited

U.S. PATENT DOCUMENTS

| | | | | |
|---|---|---|---|---|
| 5,549,064 | A | 8/1996 | Padgett | |
| 6,740,386 | B1 * | 5/2004 | Hutchison | 428/88 |
| 6,905,751 | B1 * | 6/2005 | Jauregui | 428/89 |

OTHER PUBLICATIONS

"Carpet Manufacturing Technology—Latest Developments in Carpet Tufting Technology," Crumbliss, Institute of Textile Technology, Aug. 15-16, 2002.

* cited by examiner

*Primary Examiner*—Cheryl A Juska
(74) *Attorney, Agent, or Firm*—Nixon & Vanderhye P.C.

(57) ABSTRACT

A fabric is provided having discrete surface portions of a primary backing and tufted yarns exposed on the technical face of the fabric. To form the fabric, the yarn feed controlled by servomotors is adjusted in increments to rob back yarn sufficient to pull out the previously tufted loops in selected portions of the fabric, leaving the primary backing portion of the pulled-out loops exposed on the technical face. By the selection process, random or patterned tufted portions and exposed primary backing surface portions are provided on the technical face of the fabric.

5 Claims, 5 Drawing Sheets

COVERING FOR FLOORS AND/OR WALLS

BACKGROUND OF THE INVENTION

The present invention relates to coverings for floors, walls, ceilings or the like, such as fabrics or carpeting, whether broadloom or modular, and particularly relates to coverings having discrete surface portions of primary backing and tufted yarns exposed along the technical face of the fabric.

Tufted fabrics are those fabrics in which a plurality of yarns are stitched through a primary backing or substrate, forming loops which comprise the fabric surface or which loops may be cut to form a cut loop pile fabric surface. Machinery for forming tufted fabrics typically have one or more needle bars with a plurality of needles threaded with individual yarns reciprocating relative to a moving substrate to pass the needles carrying the yarn through the substrate, forming loops. Yarn is fed to the needle bars from yarn feed rolls which are typically controlled by clutches or servomotors to enable different lengths of yarns to be fed to the needles to achieve a patterning effect in the technical face of the fabric. That is, to provide tufts, whether loop or cut, of different heights in a pattern in the technical face of the fabric, the clutches or servomotors are controlled to feed more or less yarn to the needle bars. An example of a textured surface having tufted pattern effects is disclosed in U.S. Pat. Nos. 5,383,415 and 5,549,064, of common assignee. In those patents, the feed of the yarns to the needles of the needle bar is controlled to provide selected high or low tufts in warpwise and weftwise adjacent stitches. This has proven eminently satisfactory in providing various aesthetic effects in color and patterning of the fully tufted fabric.

It will be appreciated that the primary backing for tufted pile fabric serves as a support for the pile rather than to impart any aesthetics to the carpet. That is, the primary backing is conventionally totally obscured by the tufted fabric pile and plays no role in the aesthetic design of the carpet. It will also be appreciated that the machinery for, and resulting tufted product, typically require a tufted stitch at each stitch location, whether or not a high or low stitch is provided. This requires substantial quantities of yarn material to complete a tufted pile surface for the technical face of the fabric. Accordingly, there is a need for a fabric which can be manufactured at reduced costs, requiring less surface pile material with consequent reduced disposal concerns at the end of the fabric's useful life and which may have very different aesthetic characteristics as compared with conventional tufted pile fabrics.

BRIEF DESCRIPTION OF THE INVENTION

In accordance with a preferred embodiment of the present invention, there is provided a fabric product having discrete surface portions of primary backing and tufted yarns exposed on and forming the technical face of the fabric as well as a method of manufacturing the fabric. It will be appreciated that the primary backing or substrate and tufted yarns have different discrete aesthetic characteristics, e.g., color, texture and the like. In a preferred form of the present invention, the discrete portions of the technical face comprising the tufted yarns and the exposed primary backing may be provided in a random or patterned manner to provide different surface effects. For example, the tufted yarns, either loop or cut pile yarns, may be provided at random locations along the technical face of the fabric in either single tufts or groups of multiple tufts adjacent one another, with exposed portions of the primary backing therebetween. Alternatively, the primary backing and/or the tufted portion may be patterned, for example, in alternating rows, squares, dots or many other different geometrical patterned formations. The result is an aesthetically pleasing fabric having a technical face formed of tufted yarn and exposed primary backing potions or areas interspersed with one another. This has many advantages including the production of various aesthetic characteristics, reduced quantities of yarn, less cost and reduced disposal concerns at the end of the fabric's life.

To manufacture the fabric, tufting machinery comprised of one or more needle bars, each having a plurality of needles threaded with individual yarns, are operated to pass the needles through the substrate to form tufted loops which can remain in loop form on the technical face or can be cut to form a cut loop pile surface in the tufted area of the fabric. Also, combinations of cut and loop pile known as PCU (Precision Cut/Uncut or Velva Loop) can be manufactured with similar machinery. The yarn feed to each needle is controlled by a servomotor which can advance the yarn to the needle at a substantially fine incrementally adjustable rate of feed. In conventional tufting, e.g., to produce a pile surface having a predetermined constant pile height, the rate of yarn feed is constant. In conventional tufting where high and low tufted pile patterns are desirable, the yarn feed is reduced by operation of the servomotors for those areas where the lower pile is desired. See, for example, U.S. Pat. No. 5,549,064.

In the present invention, the servomotors are selectively controlled to feed sufficient yarn to the needles to form tufts at each stitch location in the fabric and to remove tufts from selected stitch locations, e.g., areas of the fabric, where it is desired to expose the primary backing along the technical face. Particularly, a conventional tufting operation is performed with the needles passing through the substrate and loopers grabbing the yarn to form the loops, and, if desirable, knife blades to cut the yarn loops to form cut loop pile. The tufting operation includes those areas, i.e., stitch locations, where it is desired to expose the primary backing along the technical face. However, for the latter areas, the servomotors are controlled to provide a yarn feed sufficient only to form a backstitch and to remove from or pull out of the primary backing one or more previously tufted yarn loops. That is, the yarn feed is controlled to selected needles of the needle bar during tufting to withdraw through the primary backing yarn loops previously tufted into the primary backing by the selected needles to form discrete surface portions of the primary backing and tufted yarns exposed on the technical face of the fabric. It will be appreciated that by selection, e.g., a programmed computer-generated selection, of the needles and, hence, the programmed selection of the servomotors feeding the yarn to the needles, random or patterned effects in the technical face of the fabric are achieved with respective discrete portions of the technical face being formed by tufted cut or loop pile and the exposed primary backing yarns. Similar effects can be provided by machinery other than those using servometers. For example, similar patterned carpet can be achieved using clutches, full repeat pattern mechanisms (FRS), Yamagucci pattern devices, slot patterns and the like.

The fabrics hereof may be utilized in many different environments. Principal uses include carpet and wall and ceiling coverings. There are, however, many other environments in which the fabric may be used, e.g., automotive, floor mats and seating upholstery, or marine and aviation environments.

It will also be appreciated that the fabric hereof having discrete surface portions of primary backing and tufted yarns exposed on and forming the technical face of the fabric may be provided in a pattern which appears to change the aesthetic characteristics of the fabric, depending upon the perspective of the viewer. As previously noted, the exposed primary backing and tufted yarn portions of the technical face may have different aesthetic characteristics including colors, texture or geometries. For example, the primary backing may constitute the principal color or texture of the fabric when an individual is looking directly at the fabric, i.e., a direction generally perpendicular to the fabric. Thus, in a carpeting environment wherein the exposed primary backing forms the predominant portion of the carpet and the tufted yarns are provided in spaced patterns, e.g., rows along the carpet, an individual standing on the carpet would visualize the color and texture dominated by the exposed primary backing and see very little of the exposed tufted yarns. When the carpet surface is viewed from a different perspective, however, for example, from a distance and from a sharp acute angle, the exposed tufted yarns will be readily apparent and obscure, to at least some extent, if not entirely, the primary backing. As a consequence, the aesthetic characteristics, e.g., color or texture, of the fabric may change as the perspective of the viewer changes.

In a preferred embodiment according to the present invention, there is provided a method of manufacturing a tufted pile fabric having a technical face with exposed surface portions of tufted yarn and primary backing, comprising the steps of (a) providing at least one needle bar carrying a plurality of needles spaced from one another in a weft direction, (b) supplying yarns to the needles carried by the needle bar, (c) displacing the needle bar and the primary backing relative to one another in a warp direction, (d) tufting yarns into the primary backing to form yarn loops on the technical face upon relative displacement of the needle bar and the primary backing and (e) controlling yarn feed to selected needles during tufting to withdraw through the primary backing yarn loops previously tufted into the primary backing by the selected needles to form discrete surface portions of the primary backing and tufted yarns exposed on the technical face of the fabric.

In a further preferred embodiment according to the present invention, there is provided a method of manufacturing a tufted pile fabric comprising tufting yarns through a primary backing and pulling selected tufted yarns in their entirety back through the primary backing to form discrete exposed and aesthetically distinct surface portions of the primary backing and the tufted yarns on the technical face of the fabric.

In a further preferred embodiment according to the present invention, there is provided a covering for a floor, wall or ceiling surface, comprising a primary backing having discrete parts thereof exposed on one side of the covering for forming first discrete wear surface portions of a wear surface of the covering, a plurality of yarns tufted into the primary backing along remaining parts of the primary backing forming second discrete wear surface portions of the wear surface, a plurality of backstitches of the tufted yarns extending along an opposite side of the primary backing from the first discrete wear surface portions of the wear surface and a composition along the back side of the primary backing fixing the backstitches to the primary backing.

In a further preferred embodiment according to the present invention, there is provided a fabric having discrete surface portions of a primary backing and tufted yarns exposed on the technical face of the fabric, the fabric being formed by having the yarn feed controlled by servomotors adjusted in increments to rob back yarn sufficient to pull out the previously tufted loops in selected portions of the fabric, leaving the primary backing portion of the pulled-out loops exposed on the technical face such that random or patterned tufted portions and exposed primary backing surface portions are provided on the technical face of the fabric.

DETAILED DESCRIPTION OF THE INVENTION

Figure 1:
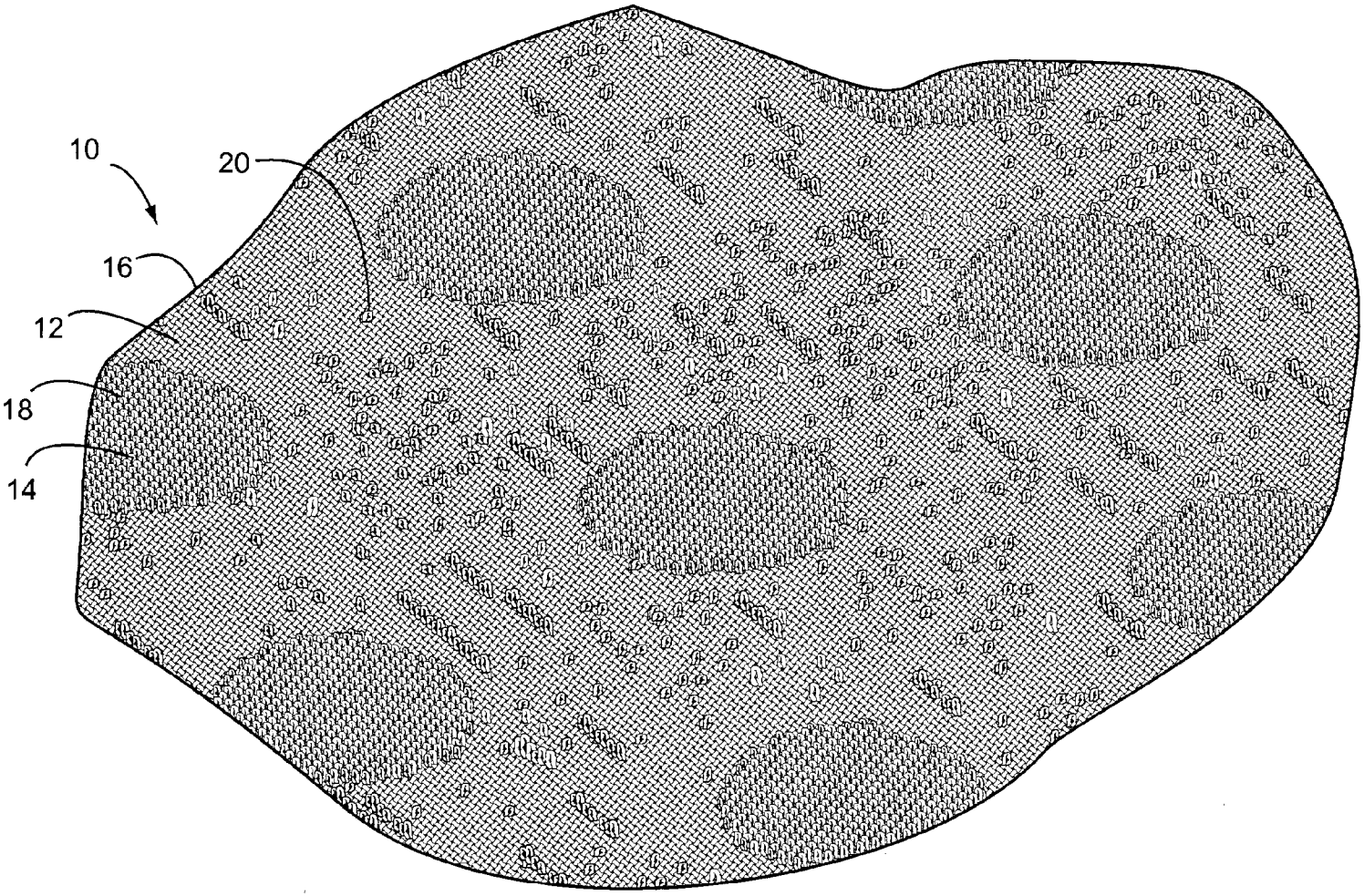
FIG. 1 is a perspective view illustrating the technical face of a representative example of a fabric constructed in accordance with the present invention.

Referring now to the drawing figures, particularly to FIG. 1, there is illustrated the technical face of a fabric, generally designated 10. In the illustrated example, the technical face includes discrete surface portions 12 and 14, respectively, of a primary backing 16 and tufted yarns 18 exposed on the technical face. The primary backing 16 is preferably formed of a woven material as is conventional and is provided with certain aesthetic characteristics such as a particular color or weave. Other types of primary backing may be used, e.g., non-wovens, needlebond, spunbond, or electrostatic flocking or the like. The exposed tufted yarns 18, as illustrated, form a tufted loop pile surface but it will be appreciated that a cut loop pile surface can be formed. The tufted yarns 18 are provided in the illustrated example in a pattern, e.g., groups of tufted loop yarns forming dots spaced from one another with exposed surface portions 12 of the primary backing 16 therebetween. Additionally, one or more tufted loops 20 may be provided in a random pattern or may be patterned through the primary backing 16 between adjacent patterned tufted loops 18. It will be appreciated that the tufted loop or cut pile surface portions can be provided in different patterns or randomly in the substrate 16, a pattern configuration being illustrated by the groups of tufted loops 18 and a random pattern being illustrated by the tufted loops 20 in the substrate 16. Thus, a patterned fabric may be formed with a combination of discrete exposed surface portions of tufted loop or cut pile surfaces and exposed surface portions of the primary backing. Alternatively, discrete surface portions may be formed of tufted loop or cut pile disposed in a random pattern in combination with exposed primary backing surface portions.

Figure 2:
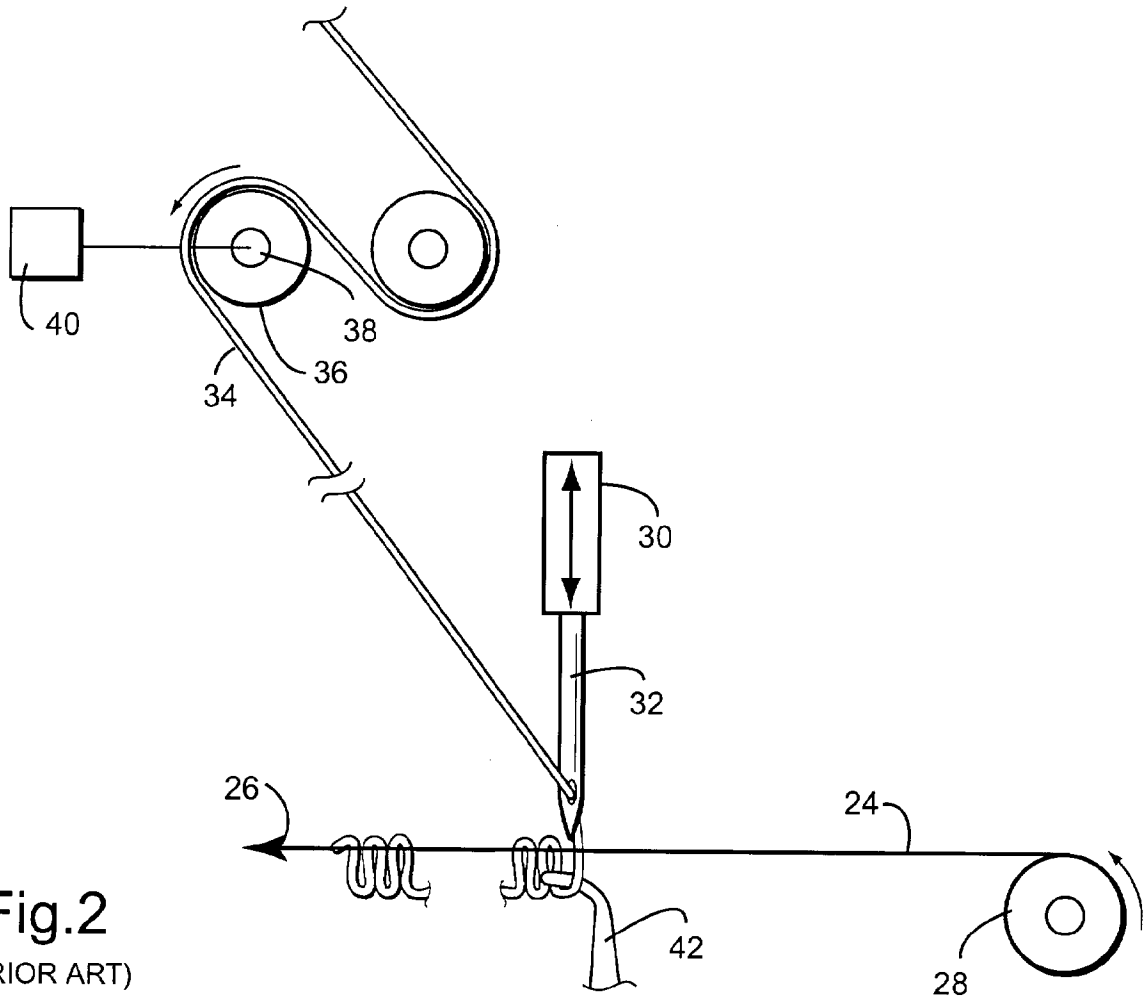
Fig.2 (PRIOR ART)
FIG. 2 is a schematic illustration of a tufting process for forming the fabric hereof.

FIG. 2 schematically illustrates a conventional tufting process using conventional tufting machinery. Particularly, a substrate or primary backing 24 is fed in the direction of the arrow 26 in FIG. 2 from a roll 28 and is tufted by one or more needle bars 30 mounting a plurality of needles 32 along its length. The needle bar 30 is reciprocated as indicated by the double-ended arrow so that the needles 32 penetrate through the substrate 24. Each of the needles 32 is provided with yarn 34 from a suitable supply, not shown, and fed to the needles by a feed roller 36 controlled by a servomotor 38 for advancing the roller to feed the yarn 34 to the needle 32. The servomotor 38 is under the control of a programmable computer 40. It will be appreciated that each servomotor is incrementally adjustable to provide a predetermined rate of yarn feed to the associated needle, depending on a number of different factors, for example, the number of stitches per inch, the height of the desired pile and the elasticity of the yarn itself. In the illustrated conventional process, the yarn 34 is fed to the needle and the needle 32 is advanced through the primary backing 24 to a predetermined depth of penetration. As the needle retracts, the yarn fed by the needle is caught by a hook or looper 42 below the primary backing 24. The looper 42 holds the yarn to form a loop as the needle retracts or backs off through the opening in the substrate. Once the needle is fully retracted and no longer penetrates the primary backing, the looper releases the yarn loop. The primary backing 24 is, of course, continuously advancing, e.g., in the warp direction indicated by arrow 26, facilitating clearing the tufted loop from the looper. At this stage, the cycle is repeated to form the additional tufted loops.

Figure 3:
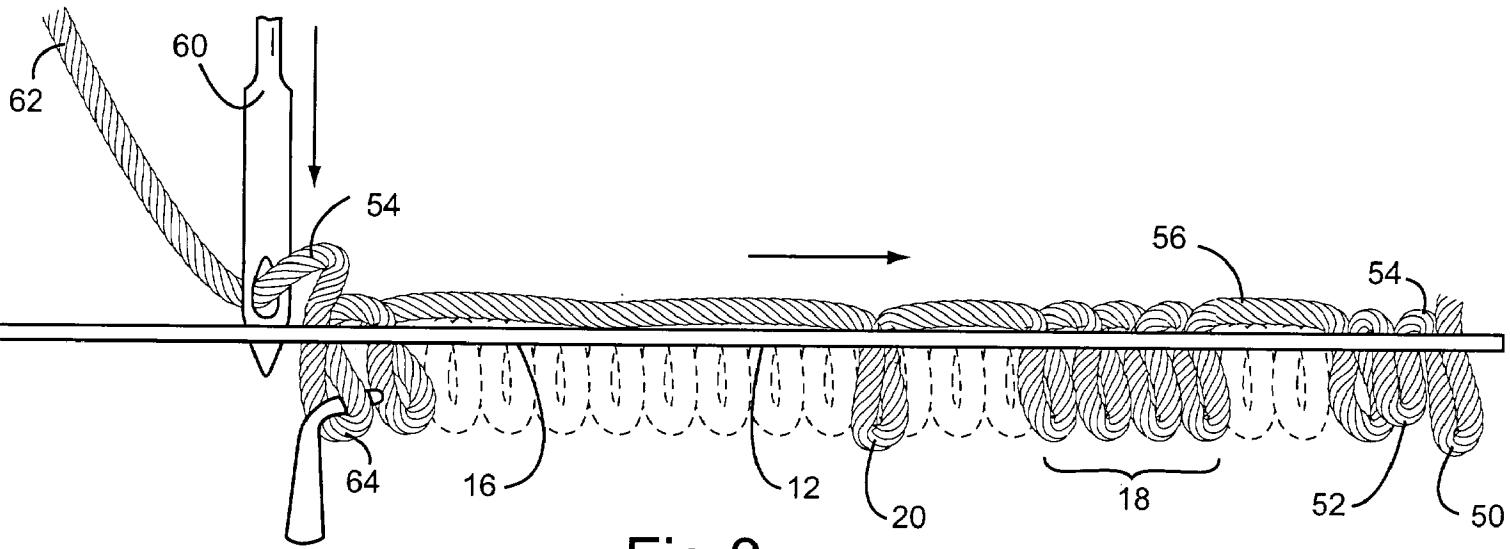
FIGS. 3–6 are schematic illustrations illustrating a tufting process by which discrete surface portions of the primary backing and tufted loop yarns are exposed on the technical face of the fabric.

In order to form a fabric having discrete surface portions of primary backing and tufted yarns exposed on the technical face of the fabric, the tufting process is modified. Referring to FIGS. 3–6, the technical face of the fabric is inverted, i.e., on the lower side of the primary backing 16 as illustrated in these drawing figures. In FIG. 3, level pile loop portions 18 of the patterned fabric of FIG. 1 are illustrated, together with individual randomly applied tufted loops 20. Additionally, exposed surface portions 12 of the substrate 16 are also illustrated on the technical face of the substrate. Furthermore, as will become clear from the ensuing description, the tufted loops can be of varying height on the technical face of the fabric. e.g., loops 50 and 52 illustrated in FIG. 3 are of different heights on the technical face. Also illustrated in FIG. 3 are the backstitches 54 of the tufted loops. The backstitches, of course, comprise the yarns which extend between adjacent stitch openings in the primary backing through which the loops are formed. The backstitches 54 may comprise a unit length of yarn extending between adjacent stitch openings in the warp direction of the fabric or multiple unit lengths of yarn 56 forming elongated backstitches underlying the surface areas on the technical face containing only the exposed surface portions 12 of the primary backing 16, as will become apparent from the ensuing description.

Figure 4:
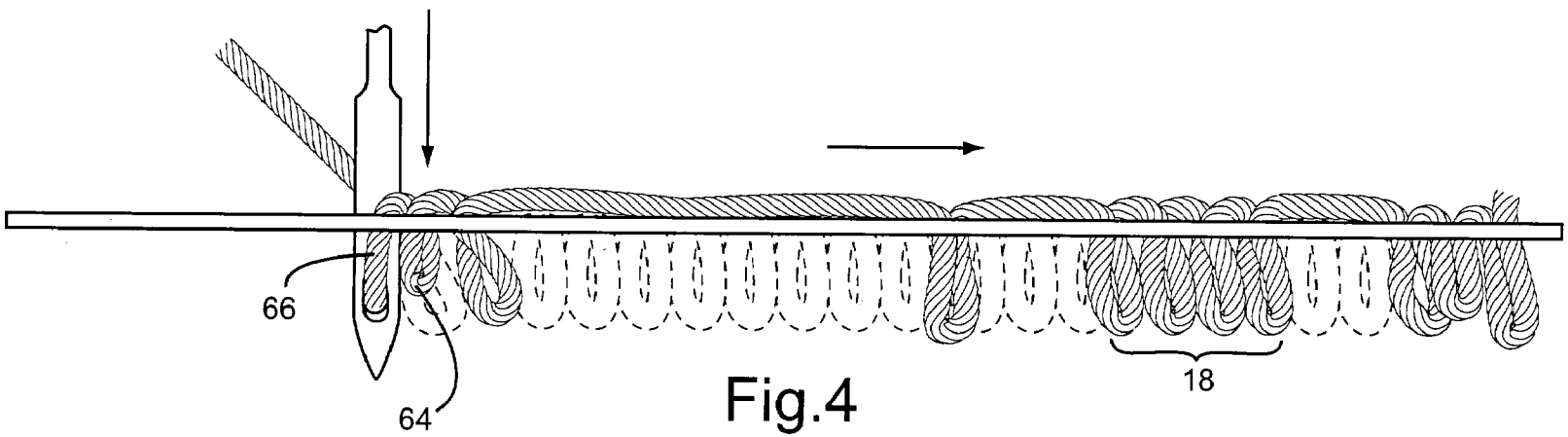

To form the exposed primary backing portions on the technical face in random or patterned areas in conjunction with the tufted loop pile portions, the tufting process proceeds conventionally. However, the yarn feed to the needles penetrating the substrate 16 in those portions, i.e., stitch locations, of the technical face in which only the substrate is to be exposed is controlled by selected servomotors to withdraw. i.e., remove, the entirety of the tuft from the substrate at those stitch locations. Particularly, and referring to FIG. 3, the substrate 16 is moving continuously from left to right in that drawing figure. It will be appreciated, however, that the substrate 16 could stop intermittently, enabling the needle to advance and retract through the stopped substrate prior to a subsequent advance of the substrate. The needle 60 carrying yarn 62 has previously formed a tufted loop 64 in substrate 16 and is moving downwardly through the substrate 16 with sufficient yarn to form a backstitch 54 of a unit length. Assuming it is desirable to form a fabric having only the primary backing exposed on the technical face at the stitch location where the tufted loop 64 has been formed, the servomotor controlling the yarn feed to needle 60 essentially stops the yarn feed. As the needle 60 passes through the substrate 16, as illustrated in FIG. 4, in the next stitch location and because insufficient yarn is being fed, the previously formed tuft 64 provides the yarn for the formation of the next tufted loop 66 being formed. Because both legs of the yarn loop 66 penetrate through substrate 16 to an extent equal to or greater than the lengths of both legs of the yarn loop 64, yarn loop 64 is completely withdrawn back through the substrate. This forms a backstitch 68 (FIG. 5) having two unit lengths, i.e., two unit distances between successive stitch openings in the warp direction. This also leaves the technical face of the substrate at that stitch location free of the previously tufted loop 64. The substrate at the removed tufted loop stitch location thus forms part of the exposed primary backing portion on the technical face.

Figure 5:
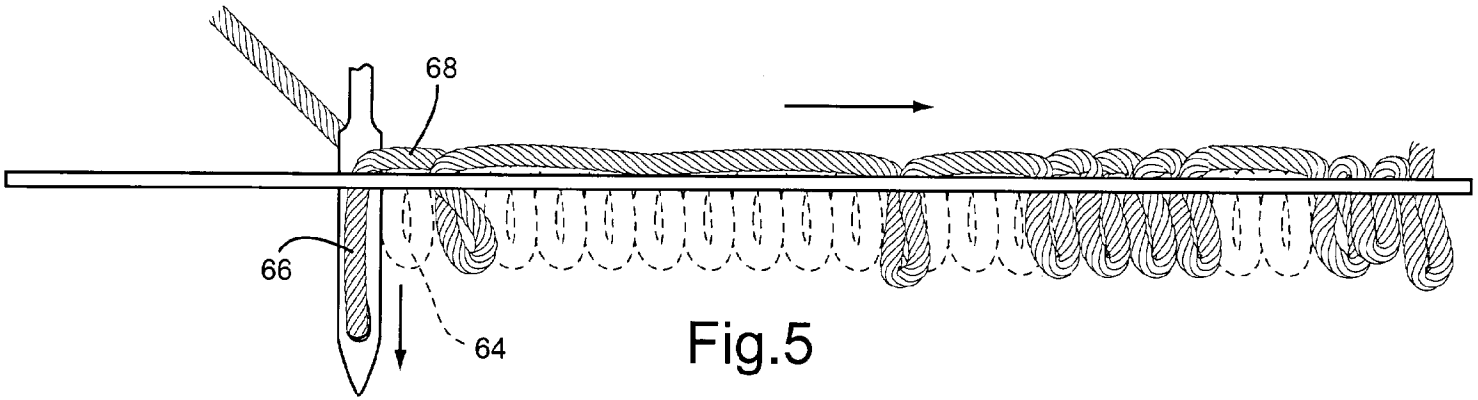
Figure 6:
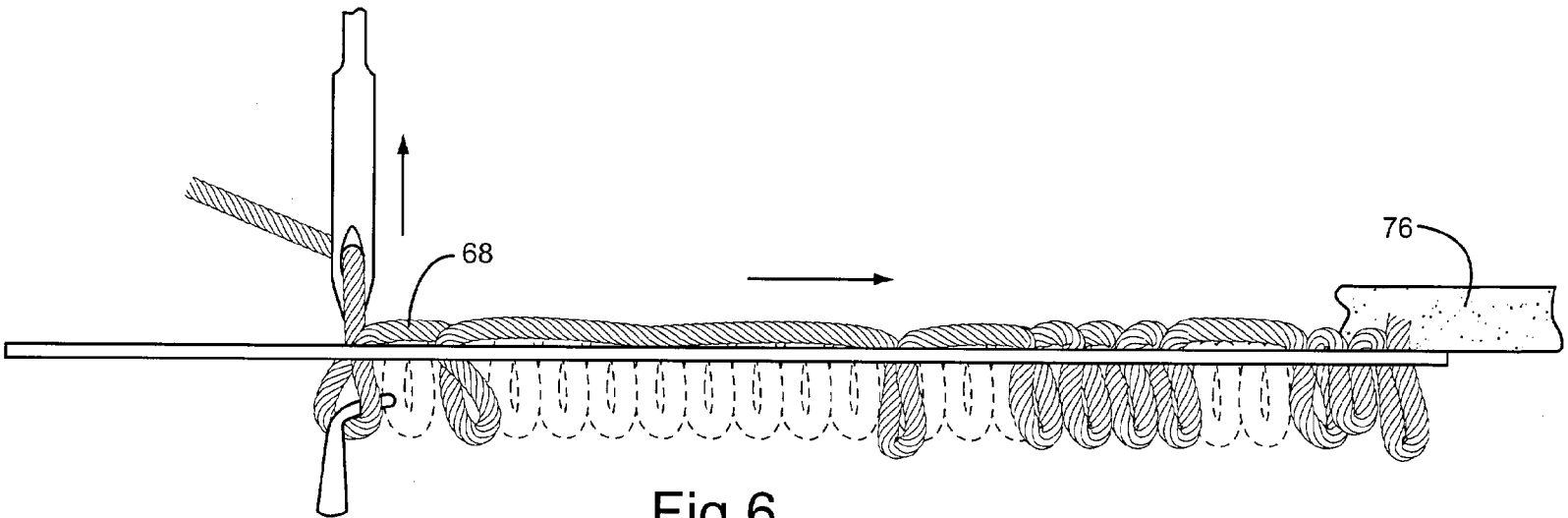

The next loop 66 being formed as illustrated in FIGS. 5 and 6 may be left on the technical face or removed. If it is desirable to leave the loop on the technical face, the servomotor under computer control is advanced to provide sufficient yarn to needle 60 such that the next subsequent loop, i.e., at the next stitch location, does not require yarn from the preceding loop, i.e., loop 66. If it is desired to remove loop 66 from the primary backing to provide a further exposed portion of the primary backing along the technical face at this next stitch location, the servomotor is controlled to incrementally advance only yarn sufficient to form a further unit length of backstitch. By thus limiting the yarn feed, the loop 66 is pulled back through the stitch opening forming an extended backstitch of multiple unit lengths.

As illustrated in FIGS. 3–6, the loops indicated by the dashed lines are those loops which have been conventionally tufted but which have been subsequently withdrawn by slowing the yarn feed sufficiently to remove the entirety of the previously tufted loop upon tufting the next loop. For example, for tufted loops extending from the primary backing 0.250 inches and at eight stitches per inch, the servomotor would normally feed approximately 0.625 inches of yarn per stitch to accommodate the two legs of the yarn loop, each having 0.250 inches in length, and the backstitch between the tufted loop and the next loop to be tufted. To remove the tufted loop at the previously tufted stitch location, the servomotor, under computer control, would essentially stop the yarn feed during the next stitch so that the prior loop can be pulled back through the primary backing. Near the upper end of the next needle stroke, the servomotor, under computer control, would feed approximately 0.125 inches to accommodate the backstitch. Thus, each successive stitch would pull out the previous tufted loop. To resume tufting with the tufted loop remaining in the technical face of the fabric, the servomotor under computer control would once again be set to feed yarn at a rate to accommodate the yarn necessary to form the next stitch, i.e., 0.625 inches, assuming the height of the loop is the same as the previous loops formed. It will also be appreciated that the height of the loops can be adjusted on a per-loop basis. To accomplish that, the servomotors would be adjusted by the computer to feed more or less yarn so that upon the subsequent loop formation, an amount of yarn would be robbed back to form a lower pile loop.

With reference to FIG. 6, it will be appreciated that the backside of the fabric from its technical face may be coated with a conventional secondary backing composition, such as a latex or a resin, indicated at 76.

Figure 7:
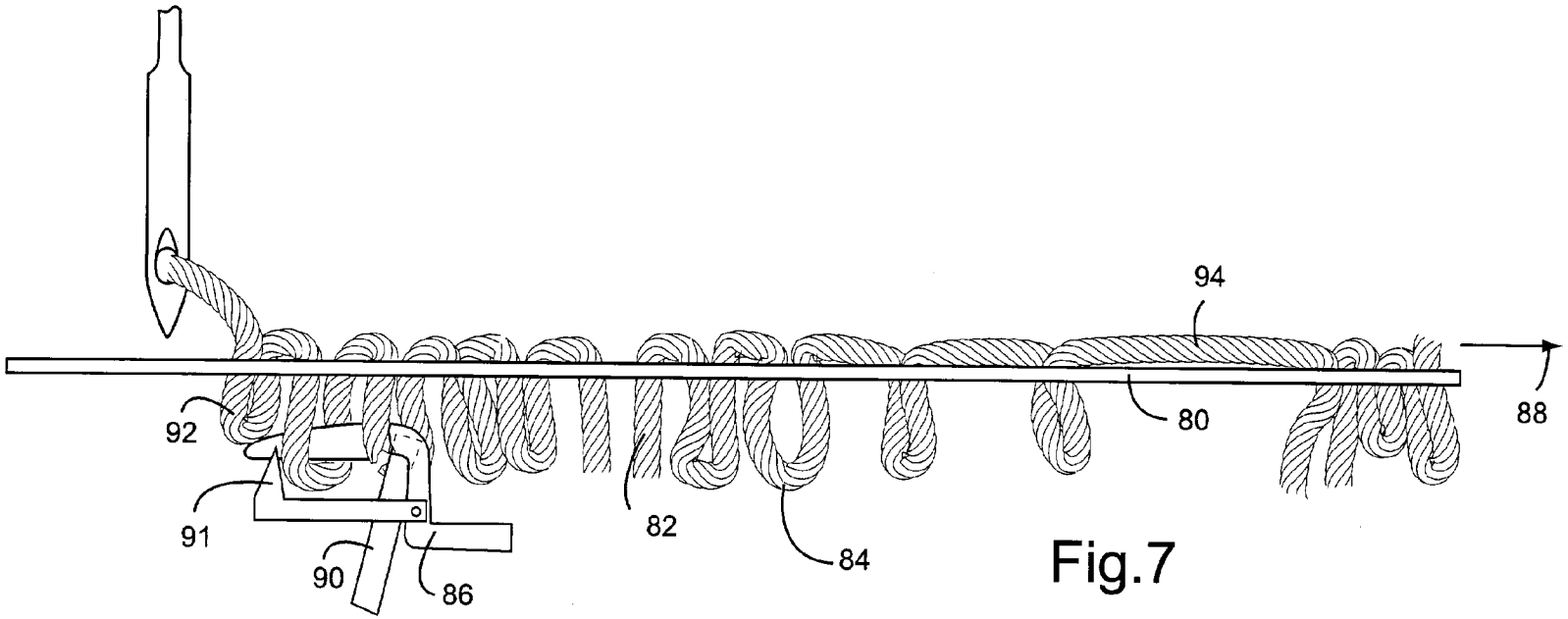
FIG. 7 is a schematic illustration of a cut loop tufting process by which discrete surface portions of the primary backing and cut loop tufted yarns are formed and exposed on the technical face of the fabric.

Referring now to FIG. 7, there is schematically illustrated the formation of a fabric product having discrete surface portions of a primary backing 80 and tufted cut pile yarns 82 or in combination with loop pile yarns 84 and forming the technical face of the fabric. In conventional tufting for forming cut loop pile, the looper 86 extends in the opposite direction from the direction of advance of the substrate 80, indicated by the arrow 88. A cutting blade 90 and a keeper 91 are associated with the looper 86. A similar robbing-back procedure is employed to form extended exposed portions of the primary backing 80 and stitches of the cut loop type. For example, FIG. 7 illustrates a loop 92 which has had insufficient yarn feed and therefore releases from the end of the looper 86 before the cutting blade 90 can cut and form a cut loop 82. Thus, the needle advance forming the next stitch would withdraw the loop 92 completely through the primary backing 80 similarly as in the loop pile formation previously described. In this manner, the elongated backstitch 94 can be provided along the side of the backing opposite its technical face by selected operation of the servomotors as previously described.

A cut loop construction can also be formed by cutting the highest pile and stripping yarns for the loops of varying heights depending on the yarn feed. Alternatively, the loops could be pulled out completely. For example, and using ten stitches per inch, the following may be provided:

| Pile Height | Extended Length of Yarn Needed to Make Individual Tuft (Programmed in Servo) |
|---|---|
| .312 cut | .724 |
| .187 loop | .474 |
| .125 loop | .350 |
| Pull out completely | .002 |

Figure 8:
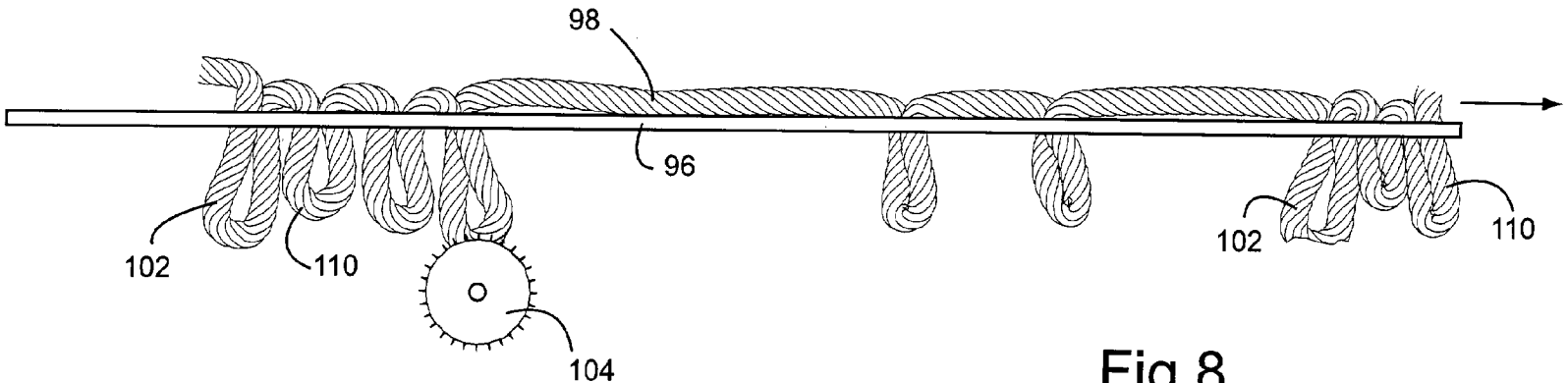
FIG. 8 is a schematic illustration of an offline tip-shearing process for the tufted loop yarns of the fabric hereof.

Referring to FIG. 8, the tufted loops formed by the process, previously described with respect to FIGS. 3–6, may have loops of varying height or the same height. A tip-shearing operation may also be performed offline to shear off a portion of the loops of the highest loops tufted into the fabric. For example, in FIG. 8, the primary backing 96 has a backstitch 98 whereby the technical face of the primary backing is exposed and a series of loops 100 and 110 of different elevations. A tip shearer 104 is schematically illustrated in FIG. 8 and comprises a reel-type device having a blade for shearing off a portion of the tip of the highest pile loops 102, as illustrated.

It will also be appreciated that the foregoing method of manufacturing the fabric may be used to provide a fabric having a change in color, texture or other aesthetic characteristics, depending upon the perspective of the viewer. For example, and where the fabric is employed in a carpet, the exposed primary backing portion and the tufted portions may have different aesthetic characteristics, including color, texture, patterns or combinations thereof. If the carpet is formed with an exposed surface formed predominantly by the exposed backing surface portion and an exposed pattern of tufts, e.g., tufted rows, the aesthetic characteristics of the carpet will change, depending upon the perspective of the viewer. Thus, a viewer standing on the carpet would visualize primarily the aesthetic characteristics of the exposed primary backing and may visualize little or none of the aesthetic characteristics of the tufted backing. However, when viewing the same carpet from a distance and at an acute angle, the viewer will visualize the raised tufts and the color, texture, pattern or combinations thereof of the raised tufts will dominate the appearance of the carpet. Therefore, as the perspective of the viewer changes, the aesthetic characteristics of the fabric may likewise change.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A covering for a floor, wall or ceiling surface, comprising:

a primary backing having discrete parts thereof exposed on one side of the covering for forming first discrete wear surface portions of a wear surface on a technical face of the covering;

a plurality of yarns tufted into said primary backing along remaining parts of said primary backing forming second discrete wear surface portions of the wear surface on the technical face of the covering including loops or cut loops of the tufted yarns;

a plurality of backstitches of the tufted yarns extending along an opposite side of the primary backing from the first discrete wear surface portions of the wear surface and along a technical back of the covering;

a composition along the a back side of the primary backing fixing said backstitches to the primary backing;

wherein said primary backing includes a plurality of regularly spaced stitch openings for receiving the tufted yarns with each stitch opening spaced a unit length from a next adjacent stitch opening in a warp direction of the fabric, said backstitches spanning between stitch openings spaced from one another in distances of multiple unit lengths in the warp direction along the technical back of the covering; and wherein each stitch opening includes either a tufted yarn on the technical face or a backstitch underlying the stitch opening along the technical back of the covering.

2. A covering according to claim 1 wherein said primary backing parts and said tufted yarns forming said first and second discrete wear surface portions of said wear surface are arranged randomly in the wear surface.

3. A covering according to claim 1 wherein said primary backing parts and said tufted yarns forming said first and second discrete wear surface portions of said wear surface are arranged in a pattern on the wear surface of the fabric.

4. A covering according to claim 3 wherein uppermost portions of the primary backing parts and tufted yarns forming the first and second discrete wear surface portions lie at different elevations in the covering, enabling an individual viewing the covering from one perspective to predominantly view the exposed primary backing parts and their predominant aesthetic characteristics and, from an a different perspective, enabling the individual to view predominantly the tufted yarns and their predominant aesthetic characteristics, thereby creating the appearance of a change in aesthetic characteristics of the covering upon a change in viewing perspective.

5. A covering according to claim 1 wherein said backstitches appear solely along the technical back of the covering.

* * * * *